US011752412B2

(12) United States Patent
Bergeron

(10) Patent No.: US 11,752,412 B2
(45) Date of Patent: Sep. 12, 2023

(54) GOLF SWING SIMULATOR/TRAINING AID

(71) Applicant: Steven F. Bergeron, St. Clair Shores, MI (US)

(72) Inventor: Steven F. Bergeron, St. Clair Shores, MI (US)

( * ) Notice: Subject to any disclaimer, the term of this patent is extended or adjusted under 35 U.S.C. 154(b) by 0 days.

(21) Appl. No.: 17/718,951

(22) Filed: Apr. 12, 2022

(65) Prior Publication Data

US 2022/0347543 A1 Nov. 3, 2022

Related U.S. Application Data

(60) Provisional application No. 63/183,115, filed on May 3, 2021.

(51) Int. Cl.

| | |
|---|---|
| ***A63B 53/00*** | (2015.01) |
| ***A63B 69/36*** | (2006.01) |
| ***A63B 53/14*** | (2015.01) |

(52) U.S. Cl.

CPC ..... *A63B 69/3632* (2013.01); *A63B 53/14* (2013.01)

(58) Field of Classification Search

CPC ..... A63B 69/3632; A63B 53/14; A63B 60/02; A63B 71/0045; A63B 2210/50; A63B 15/00

USPC ..... 473/203–206, 219–226, 231–239, 266, 473/256, 257, 316, 288, 296, 269, 300, 473/306, 307, 322, 323

See application file for complete search history.

(56) References Cited

U.S. PATENT DOCUMENTS

| | | | | |
|---|---|---|---|---|
| 1,930,342 | A | 10/1933 | Graham | |
| 2,950,115 | A * | 8/1960 | Hurdzan | A63B 15/005 473/234 |
| 3,136,546 | A | 6/1964 | Connolly | |
| 3,229,980 | A | 1/1966 | Silberman | |
| 3,428,325 | A | 2/1969 | Atkinson | |
| 3,743,297 | A | 7/1973 | Dennis | |
| 4,027,886 | A * | 6/1977 | Katsube | A63B 69/3632 273/456 |
| 5,249,803 | A | 10/1993 | Giffin | |
| 5,312,308 | A | 5/1994 | Hamilton et al. | |
| 5,443,435 | A | 8/1995 | Wilkinson | |
| 5,490,825 | A | 2/1996 | Wilkinson | |
| 5,582,407 | A | 12/1996 | Sorenson | |
| 5,586,957 | A | 12/1996 | Wilkinson | |
| 5,613,915 | A | 3/1997 | Van Alen, Jr. | |
| 5,769,734 | A | 6/1998 | Qualey, Sr. | |
| 5,997,412 | A * | 12/1999 | Benson | A63B 53/00 473/316 |
| 6,371,865 | B1 * | 4/2002 | Magliulo | A63B 60/00 473/297 |

(Continued)

*Primary Examiner* — Nini F Legesse

(74) *Attorney, Agent, or Firm* — CHRISTOPHER P. MAIORANA, P.C.

(57) ABSTRACT

A golf swing simulator/training aid includes a first rod section, a second rod section, a third rod section, a fixed weight, a grip, a first threaded connector fitting, and a second threaded connector fitting. The fixed weight is generally secured to a first end of the first rod section. The grip is generally attached to and surrounding a second end of the third rod section. The first threaded connector fitting may removably couple the first rod section to the second rod section. The second threaded connector fitting may removably couple the second rod section to the third rod section.

20 Claims, 7 Drawing Sheets

(56) References Cited

U.S. PATENT DOCUMENTS

| | | | | |
|---|---|---|---|---|
| 6,371,866 | B1 * | 4/2002 | Rivera | A63B 53/02 473/307 |
| 7,172,514 | B2 * | 2/2007 | Benson | A63B 53/00 473/239 |
| 7,232,376 | B2 | 6/2007 | Droppleman | |
| 7,618,328 | B2 * | 11/2009 | Davenport | A63B 69/3623 473/219 |
| 7,762,929 | B1 | 7/2010 | Celone | |
| 8,313,392 | B2 | 11/2012 | White | |
| 8,500,609 | B1 | 8/2013 | Williams | |
| 8,529,365 | B1 | 9/2013 | Davis | |
| 8,540,584 | B1 | 9/2013 | Sorenson | |
| 9,028,378 | B2 | 5/2015 | Shah | |
| 10,905,934 | B2 | 2/2021 | Kundra et al. | |
| 11,167,193 | B2 * | 11/2021 | Christiansen | A63B 69/3632 |
| 2002/0091010 | A1 | 7/2002 | Tanimoto | |
| 2003/0224867 | A1 * | 12/2003 | Ota | A63B 60/08 473/256 |
| 2004/0102255 | A1 * | 5/2004 | Benson | A63B 53/00 473/296 |
| 2005/0143186 | A1 * | 6/2005 | Blattner | A63B 53/14 473/306 |
| 2007/0004528 | A1 | 1/2007 | Hocknell et al. | |
| 2007/0123399 | A1 | 5/2007 | Kim | |
| 2010/0105495 | A1 * | 4/2010 | Libonati | A63B 60/04 473/226 |
| 2014/0031178 | A1 | 1/2014 | Deschesnes et al. | |
| 2014/0051554 | A1 | 2/2014 | Walker | |
| 2014/0187342 | A1 * | 7/2014 | Brady | A45F 3/04 473/288 |
| 2021/0046348 | A1 | 2/2021 | Arnold et al. | |

* cited by examiner

GOLF SWING SIMULATOR/TRAINING AID

This application relates to U.S. Provisional Application No. 63/183,115, filed May 3, 2021, which is hereby incorporated by reference in its entirety.

FIELD OF THE INVENTION

The invention relates to golf practice implements generally and, more particularly, to a method and/or apparatus for implementing a golf swing simulator/training aid.

BACKGROUND

There are few, if any golf training aids that are not overly heavy and not substantially eccentrically off balanced relative to a conventional club. If a user desires a full size implement for practicing the golf swing that is weighted like and, when swung in the manner of a golf club, feels like a conventional golf club, the user is likely to choose a conventional golf club, with which the user can either practice his/her swing or hit balls on a driving range. Most golf swing training devices are consistently relatively heavy compared to a conventional golf club because their objective is muscle strengthening or muscle training. There is no golf swing practice aids available that feel like a conventional golf club and can be broken down for storage or to be carried easily while traveling.

It would be desirable to implement a golf swing simulator/training aid.

SUMMARY

The invention concerns a golf swing simulator/training aid comprising a first rod section, a second rod section, a third rod section, a fixed weight, a grip, a first threaded connector fitting, and a second threaded connector fitting. The fixed weight is generally secured to a first end of the first rod section. The grip is generally attached to and surrounding a second end of the third rod section. The first threaded connector fitting may removably couple the first rod section to the second rod section. The second threaded connector fitting may removably couple the second rod section to the third rod section.

BRIEF DESCRIPTION OF THE FIGURES

Embodiments of the invention will be apparent from the following detailed description and the appended claims and drawings.

DETAILED DESCRIPTION OF THE EMBODIMENTS

Embodiments of the present invention include providing a golf swing simulator/training aid that may (i) be comprised of three main plastic rods or sections, two long and one short, (ii) have a single fixed metal weight adhered to an end of one of a first of the long sections, (iii) allow a number of removable weights to be added adjacent to the single fixed metal weight, provide a golf grip handle or training grip on one end of a second of the long sections, (iv) provide an eight-inch center extension rod for longer swing plane work. (v) benefit a golfer by improving swing tempo and strength training for core muscles and all affected golf swing muscles, (vi) be broken down or disassembled for ease of carrying and storage, and/or (vii) be impermeable to heat and/or cold.

In various embodiments, a golf swing simulator/training aid is provided for facilitating indoor practice. In various embodiments, the golf swing simulator/training aid may comprise a plurality of sections (e.g., 3) that may be removably assembled. In an example, the plurality of sections of the golf swing simulator/training aid, when assembled, may have a total length from about 31 and a half inches to about 39 and a half inches. In one example, the golf swing simulator/training aid may include a standard golf grip on one end and a fixed weight at the other end. In another example, the golf swing simulator/training aid may include a training grip on the one end. In various embodiments, the golf swing simulator/training aid generally allows the addition of a variety of removable auxiliary weights. In an example, the removable auxiliary weights may be configured to slide along the first rod section to abut the fixed weight. In an example, a retaining ring may be slid along the first rod section to hold the removable auxiliary weights adjacent to the fixed weight. By providing a variety of weights, the golf swing simulator/training aid may implement a swing moment that is substantially similar to a number of regular golf clubs (e.g., putter, iron, wood, etc.). In various embodiments, the golf swing simulator/training aid generally provides a similar feel, heft, and swinging weight for practice of golf strokes in confined spaces. By comprising a number of removably assembled sections, the golf swing simulator/training aid may be broken down or disassembled for ease of carrying and storage.

Figure 1:
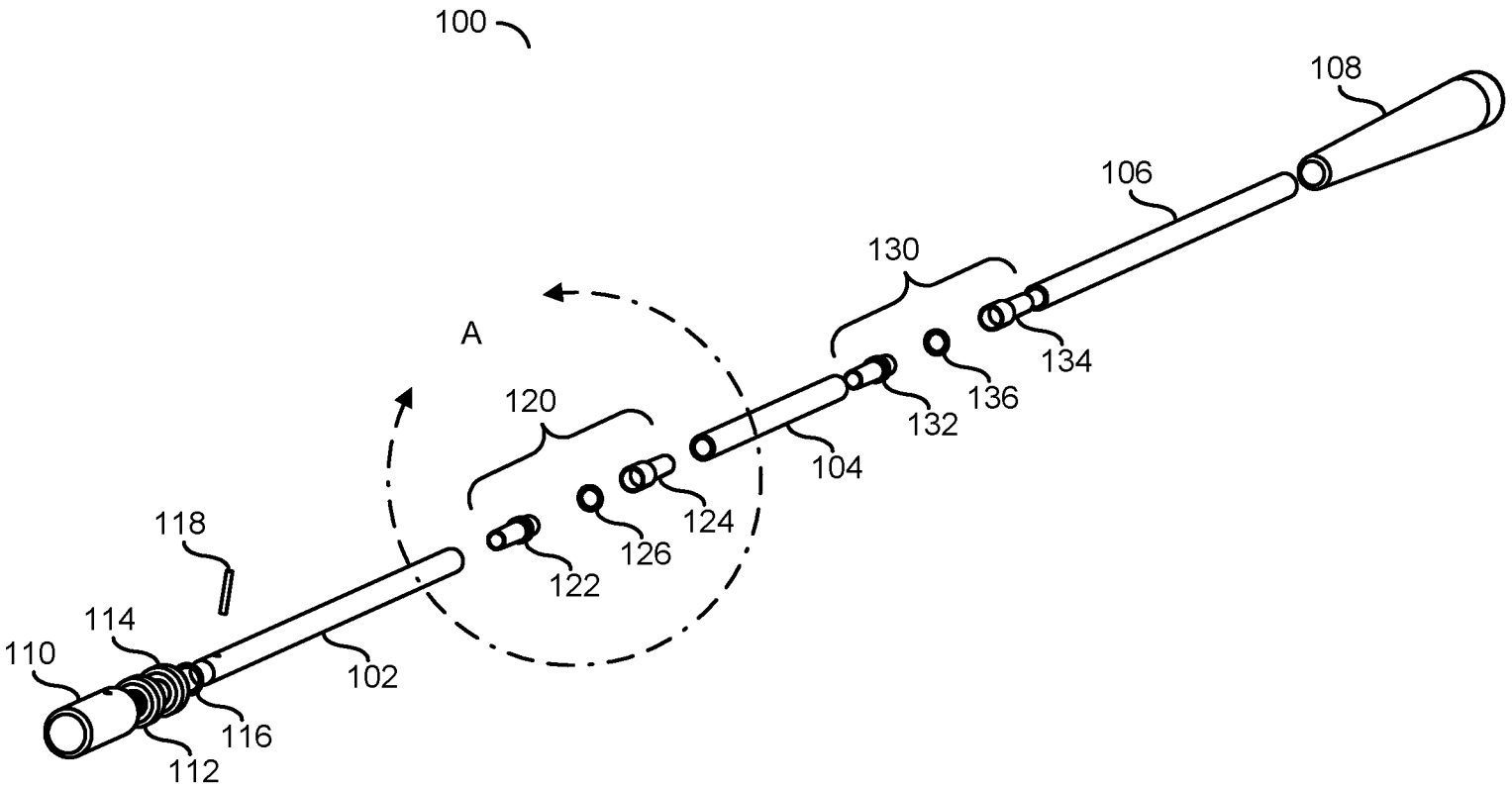
FIG. 1 is an exploded view illustrating components of a golf swing simulator/training aid in accordance with an example embodiment of the invention.

Referring to FIG. 1, an exploded view is shown illustrating components of a golf swing simulator/training aid 100 in accordance with an example embodiment of the invention. In an example embodiment, the golf swing simulator/training aid 100 may comprise a first rod section (or shaft) 102, a second rod section (or shaft) 104, a third rod section (or shaft) 106, a grip 108, and a fixed primary weight 110. In an example, the first rod section 102 and the third rod section 106 may be longer than the second rod section. In an example, the first rod section 102 may be about fifteen inches long, the second rod section 104 may be about eight inches long, and the third rod section 106 may be about fifteen inches long. In another example, the first rod section 102 may be about seventeen inches long, the second rod section 104 may be about eight inches long, and the third rod section 106 may be about thirteen inches long. However, other lengths may be implemented for the first rod section 102, second rod section 104, and the third rod section 106.

In various embodiments, the golf swing simulator/training aid 100 may further comprise an auxiliary weight 112 and an auxiliary weight 114. In an example, various combinations of the fixed primary weight 110, the auxiliary weight 112, and the auxiliary weight 114 generally allow the golf swing simulator/training aid 100 to simulate a variety of golf clubs (e.g., putter, iron, wood, etc.). In an example, the fixed primary weight 110 may have a mass of approximately 200 grams. In an example, the auxiliary weight 112 and the auxiliary weight 114 may each have a mass of approximately 40 grams. However, other masses may be implemented to meet design criteria of a particular application. Although two auxiliary weights are illustrated, any number of auxiliary weights may be implemented accordingly.

In various embodiments, the fixed primary weight 110 may be solidly attached to a first end of the first rod section 102 using a pin 118 and epoxy or other applied gluing (or bonding) agent. In an example, the pin 118 may be implemented as a brass pin. A second end of the first rod section 102 may be removably coupled to a first end of the second rod section 104 by a threaded coupling 120 (described in more detail in connection with FIG. 3 below). The threaded coupling 120 may comprise a male threaded connection fitting 122, a female threaded connection fitting 124, and a coupling ring 126. In an example, the male threaded connection fitting 122 may be solidly attached (e.g., using epoxy, etc.) to the second end of the first rod section 102. The female threaded connection fitting 124 may be solidly attached (e.g., using epoxy, etc.) to the first end of the second rod section 104.

A second end of the second rod section 104 may be removably coupled to a first end of the third rod section 106 by a threaded coupling 130. The threaded coupling 130 is generally implemented similarly to the threaded coupling 120. The threaded coupling 130 may comprise a male threaded connection fitting 132, a female threaded connection fitting 134, and a coupling ring 136. In an example, the male threaded connection fitting 132 may be solidly attached (e.g., using epoxy, etc.) to the second end of the second rod section 104. The female threaded connection fitting 134 may be solidly attached (e.g., using epoxy, etc.) to the first end of the third rod section 106.

In various embodiments, the rod sections 102, 104, and 106 may be fabricated from a plastic material. In an example, the rod sections 102, 104, and 106 may be fabricated from one-half inch acetyl copolymer rod (e.g., Delrin® acetal homopolymer (Polyoxymethylene POM) available from DuPont, Wilmington, Del.). In some embodiments, the third rod section 106 may be fabricated from a metal material. In an example, the third rod section 106 may be fabricated from one-half inch aluminum rod. In an example, the third rod section 106 may be fabrication from one-half inch diameter 6061-T6 aluminum round bar. However, other materials may be utilized. The grip 108 is generally attached to a second end of the third rod section 106. In an example, the grip 108 may be attached in a manner that facilitates replacement for wear and/or varying the grip type. In various embodiments, the grip 108 may be implemented using a standard conventional golf grip. However, other types of grips may be implement (e.g., a training grip) to meet design criteria. In various embodiments, the fixed weight 110, the auxiliary weight 112, and the auxiliary weight 114 may be fabricated from solid stainless steel. In an example, the fixed weight 110, the auxiliary weight 112, and the auxiliary weight 114 may be fabricated from one inch diameter 303 stainless steel rod. However, any similarly weighted metal or other material may be utilized accordingly.

Figure 2A:
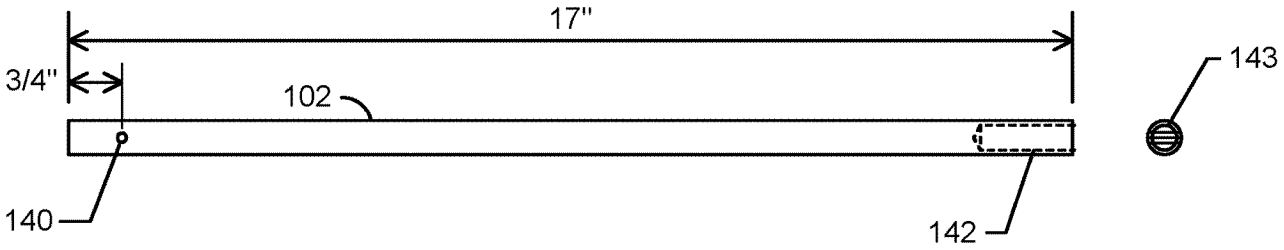
FIGS. 2A-2C are diagrams illustrating rod sections of a golf swing simulator/training aid in accordance with an example embodiment of the invention.

Referring to FIG. 2A, a diagram is shown illustrating the first rod section 102 of the golf swing simulator/training aid 100 of FIG. 1. In an example, the first rod section 102 may be implemented with a length of about fifteen inches. In another example, the first rod section 102 may be implemented with a length of about seventeen inches. However, other lengths may be implemented to meet deign criteria of an application. In an example, the first end of the first rod section 102 may have a through hole 140. The through hole 140 may be configured to receive the pin 118 to solidly attach the fixed primary weight 110 to the first end of the first rod section 102. In an example, the through hole 140 may be located approximately three-quarters of an inch from the first end of the first rod section 102. In an example, the through hole 140 may have a diameter of approximately one-eighth of an inch and a length of approximately seven-eighths of an inch.

In an example, the second end of the first rod section 102 may have a pocket 142. A detail 143 illustrates a view looking endwise at the second end of the first rod section 102. The pocket 142 may be configured to receive the male threaded connection fitting 122. In an example, the pocket 142 may have a diameter of about three-eighths of an inch and a depth of approximately one and three-eighths inches. In an example, the male threaded connection fitting 122 may be solidly attached (e.g., using epoxy, etc.) within the pocket 142.

Figure 2B:
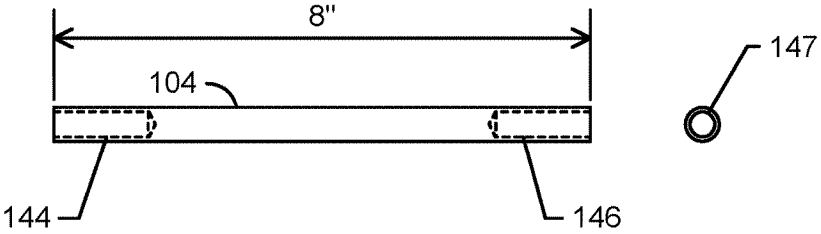

Referring to FIG. 2B, a diagram is shown illustrating the second rod section 104 of the golf swing simulator/training aid 100 of FIG. 1. In an example, the second rod section 104 may be implemented with a length of about eight inches. However, other lengths may be implemented to meet deign criteria of an application. In an example, the first end of the second rod section 104 may have a pocket 144 and the second end of the second rod section 104 may have a pocket 146. The pocket 144 may be configured to receive the female threaded connection fitting 124. In an example, the pocket 144 may have a diameter of about three-eighths of an inch and a depth of approximately one and three-eighths inches. In an example, the female threaded connection fitting 124 may be solidly attached (e.g., using epoxy, etc.) within the pocket 144.

The pocket 146 may be configured to receive the male threaded connection fitting 132. A detail 147 illustrates a view looking endwise at the second end of the second rod section 104. In an example, the pocket 146 may have a diameter of about three-eighths of an inch and a depth of approximately one and three-eighths inches. In an example, the male threaded connection fitting 132 may be solidly attached (e.g., using epoxy, etc.) within the pocket 146.

Figure 2C:
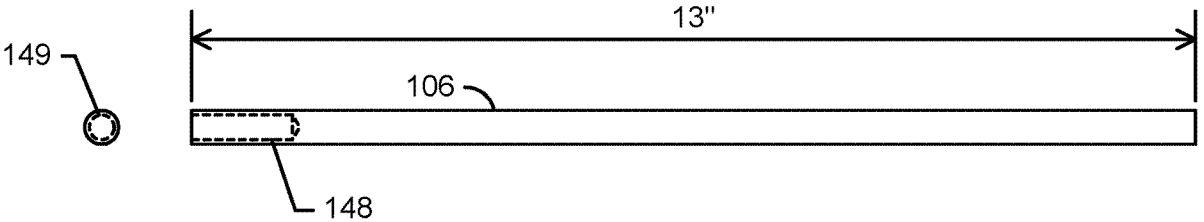

Referring to FIG. 2C, a diagram is shown illustrating the third rod section 106 of the golf swing simulator/training aid 100 of FIG. 1. In an example, the third rod section 106 may be implemented with a length of about thirteen inches. In another example, the third rod section 106 may be implemented with a length of about fifteen inches. However, other lengths may be implemented to meet deign criteria of a particular application. In an example, the first end of the third rod section 106 may have a pocket 148. The pocket 148 may be configured to receive the female threaded connection fitting 134. A detail 149 illustrates a view looking endwise at the first end of the third rod section 106. In an example, the pocket 148 may have a diameter of about three-eighths of an inch and a depth of approximately one and one-half inches. In an example, the female threaded connection fitting 134 may be solidly attached (e.g., using epoxy, etc.) within the pocket 148.

In some embodiments implementing the third rod section 106 in aluminum, an interior surface of the pocket 148 in the first end of the third rod section 106 may be smooth (or non-threaded). In some embodiments implementing the third rod section 106 in aluminum, an interior surface of the pocket 148 in the first end of the third rod section 106 may be threaded. In some embodiments implementing the third rod section 106 in aluminum, the first end of the third rod section 106 may be machined to form the female threaded connection fitting 134, thus eliminating the need for the pocket 148 and use of epoxy or other bonding agent.

Figure 3:
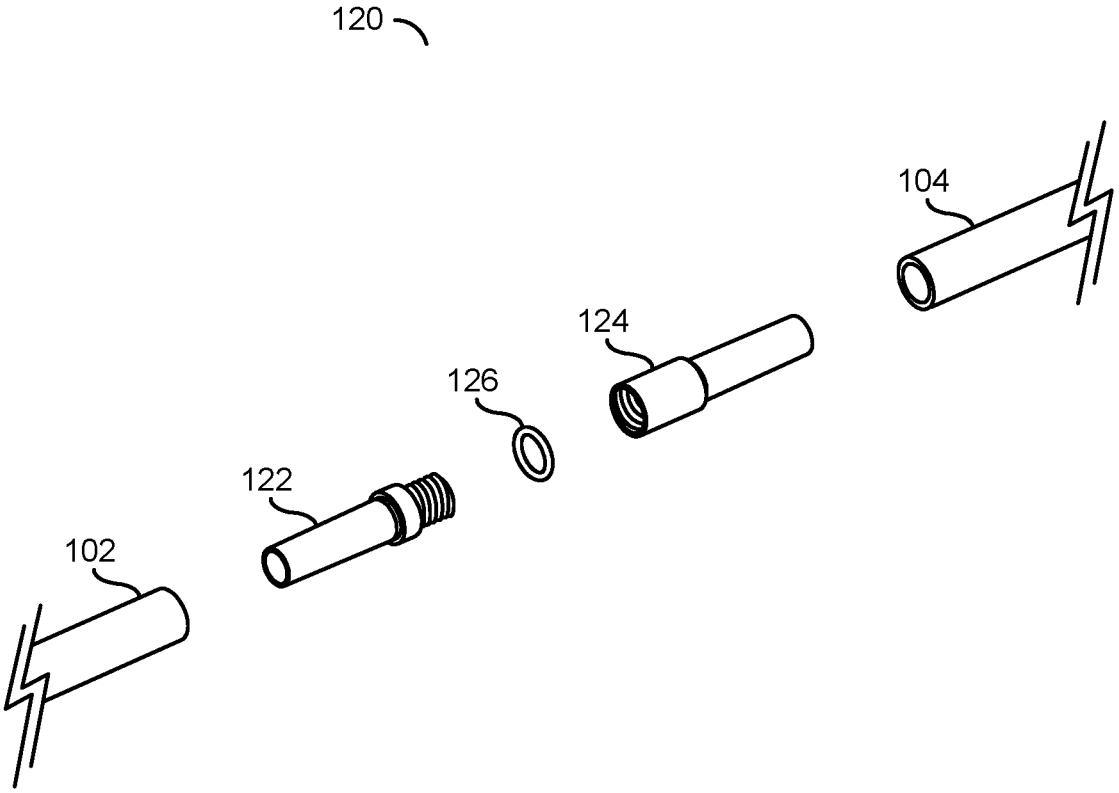
FIG. 3 is a diagram illustrating a threaded coupling between rod sections of a golf swing simulator/training aid in accordance with an example embodiment of the invention.

Referring to FIG. 3, a diagram is shown illustrating the threaded coupling 120 between rod sections 102 and 104 of the golf swing simulator/training aid 100 of FIG. 1. In an example, the male threaded connection fitting 122 may be inserted into a pocket in the second end of the rod section 102 and solidly attached to the first rod section 102 using an epoxy or other applied gluing agent. Similarly, the female threaded connection fitting 124 may be inserted into a pocket in the first end of the second rod section 104 and solidly attached to the second rod section 104 using an epoxy or other applied gluing agent.

When the rod sections 102 and 104 of the golf swing simulator/training aid 100 are assembled, the coupling ring 126 is generally placed over the threads of the male threaded connection fitting 122. The coupling ring 126 generally facilitates easy disassembly of the rod sections 102 and 104 (e.g., by preventing the threaded connection fittings being overly tightened during use). In an example, the threaded connection fittings 122, 124, 132, and 134 may be fabrication from aluminum rod. In an example, the threaded connection fittings 122, 124, 132, and 134 may be fabrication from one-half inch diameter 6061-T6 aluminum round bar. In an example, the coupling ring 126 may be implemented as a rubber o-ring. In various embodiments, the rod sections 104 and 106 may be joined together similarly by the threaded coupling 130. In an example, a non-threaded portion of each of the male threaded connection fitting 122, the female threaded connection fitting 124, the male threaded connection fitting 132, and the female threaded connection fitting 134 may be tapered to facilitate a snug fit within the pockets 142, 144, 146, and 148.

Figure 4:
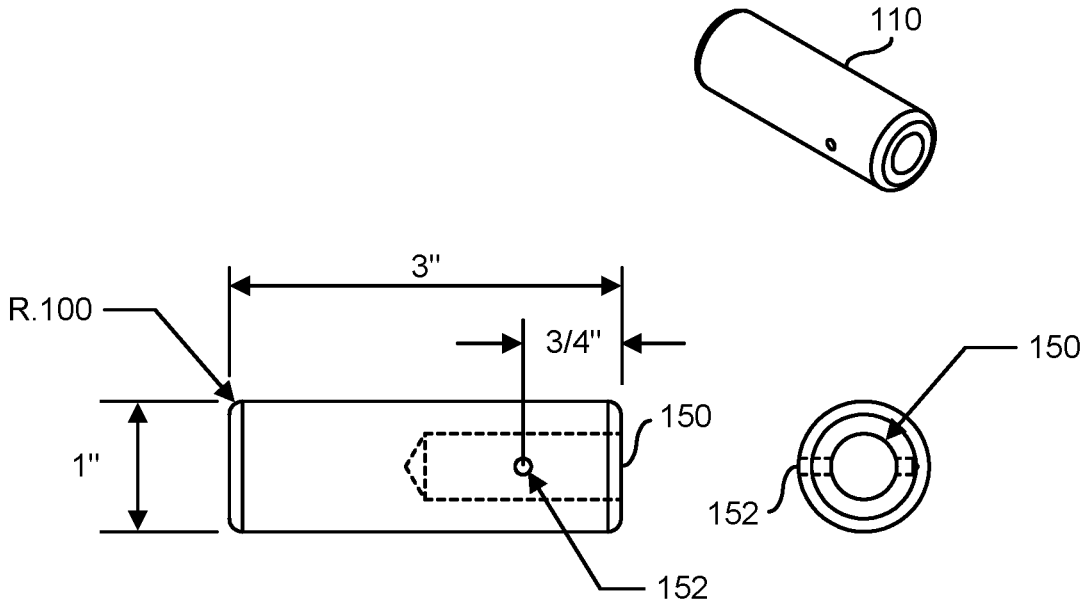
FIG. 4 is a diagram illustrating a primary fixed weight of a golf swing simulator/training aid in accordance with an example embodiment of the invention.

Referring to FIG. 4, a diagram is shown illustrating an example primary fixed weight of a golf swing simulator/training aid in accordance with an example embodiment of the invention. In an example embodiment, the primary fixed weight 110 may comprise a cylindrical metal weight configured to be solidly attached to the first end of the first rod section 102. However, other shapes (e.g., polygonal) of metal weights may be implemented. In an example, the cylindrical primary fixed weight 110 may be implemented having a diameter of approximately one inch and length of about three inches. In an example, the cylindrical primary fixed weight 110 may be fabricated using one inch diameter stainless steel rod.

In an example, a cavity (or pocket) 150 may be formed within one end of the primary fixed weight 110. The pocket 150 may have a diameter of about one-half inch and a depth of about one and one-half inches. The pocket 150 is generally configured to fit snugly onto the first end of the first rod section 102. In an example, the end of the primary fixed weight 110 with the pocket 150 may have a through hole 152. The through hole 152 may be configured to receive the pin 118 to solidly attach the fixed primary weight 110 to the first end of the first rod section 102. In an example, the through hole 152 may be located approximately three-quarters of an inch from the end of the primary fixed weight 110. In an example, the through hole 152 may have a diameter of approximately one-eighth of an inch and a length of approximately seven-eighths of an inch. In an example, the cylindrical primary fixed weight 110 may be solidly attached to the first rod section 102 using the brass pin 118 and epoxy or other applied gluing agent.

Figure 5:
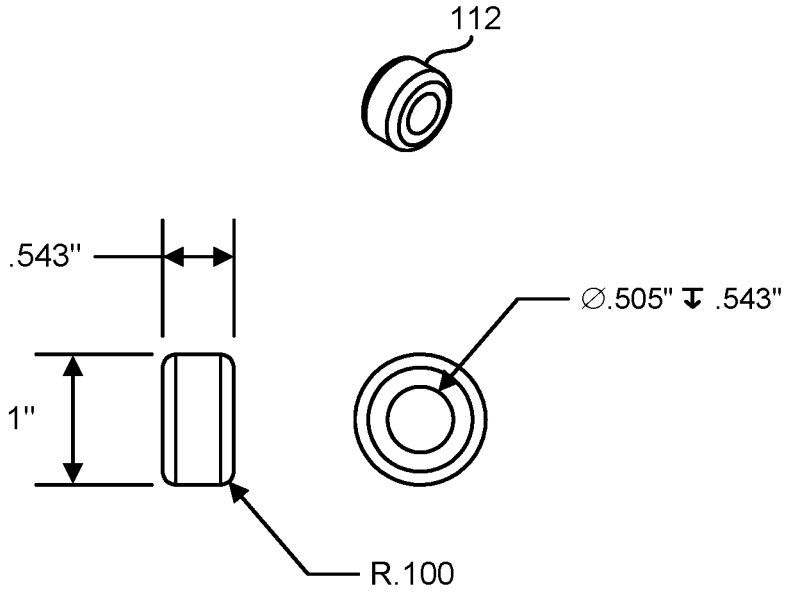
FIG. 5 is a diagram illustrating an example auxiliary removable weight of a golf swing simulator/training aid in accordance with an example embodiment of the invention.

Referring to FIG. 5, a diagram is shown illustrating an example removable auxiliary weight of a golf swing simulator/training aid in accordance with an example embodiment of the invention. In an example embodiment, the removable auxiliary weight 112 (or 114) may comprise annular rings configured to be slid onto the first rod section 102 and positioned adjacent to the fixed weight 110. In an example, the removable auxiliary weight 112 (or 114) may be implemented having an outside diameter of approximately one inch and defining an interior opening having a diameter of about one-half inch. In an example, the removable auxiliary weight 112 (or 114) may be implemented having a thickness of about one-half to five-eighths inch. In various embodiments, the removable auxiliary weights 112 and 114 may be implemented having similar or different thicknesses. In an example, the removable auxiliary weight 112 (or 114) may be fabricated using one inch diameter stainless steel rod.

Figure 6:
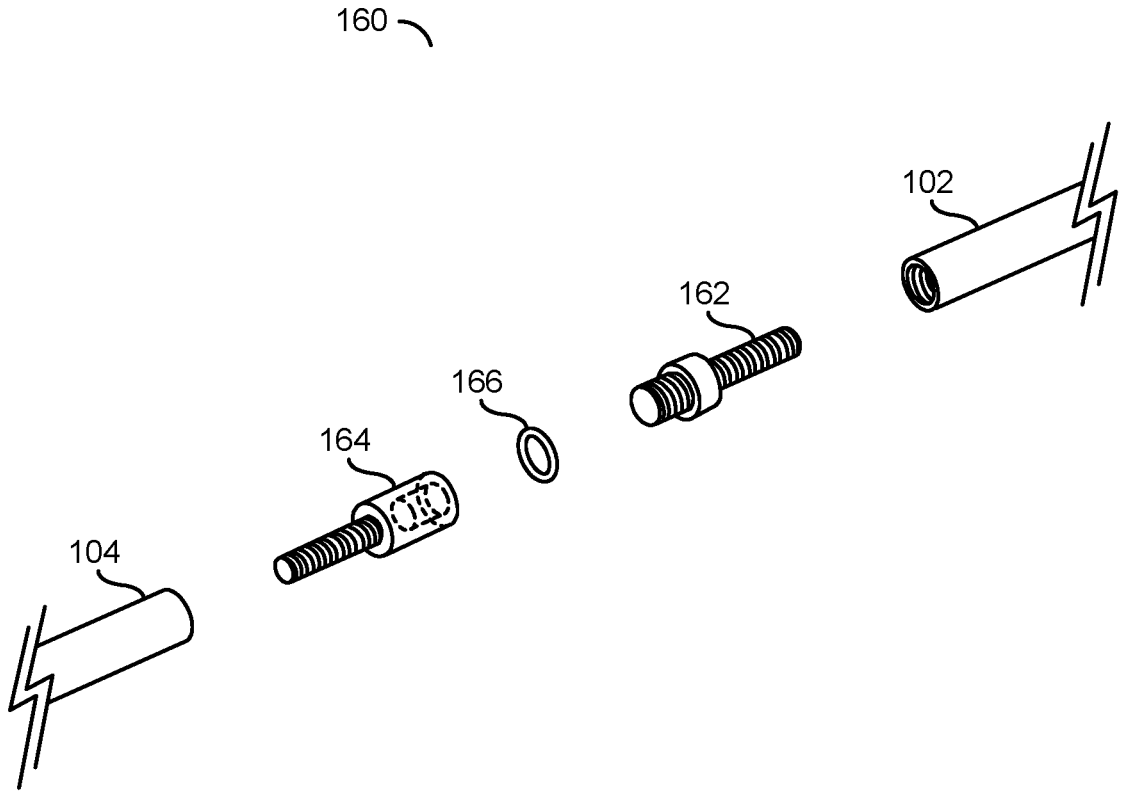
FIG. 6 is a diagram illustrating a threaded coupling between rod sections of a golf swing simulator/training aid in accordance with another example embodiment of the invention.

Referring to FIG. 6, a diagram is shown illustrating a threaded coupling between rod sections of a golf swing simulator/training aid in accordance with another example embodiment of the invention. In an example, a threaded coupling 160 is illustrated connecting the first rod section 102 to the second rod section 104. In an example, the threaded coupling 160 may be used in place of the threaded coupling 120 and/or the threaded coupling 130 illustrated in FIG. 1. In an example, the threaded coupling 160 may comprise a male threaded connection fitting 162, a female threaded connection fitting 164, and a coupling ring 166.

In an example, the male threaded connection fitting 162 may be threaded into the second end of the first rod section 102 and solidly attached (e.g., using epoxy, etc.) to the second end of the first rod section 102. The female threaded connection fitting 124 may be threaded into the first end of the first rod section 104 and solidly attached (e.g., using epoxy, etc.) to the first end of the second rod section 104. In an example, the pocket 142 in the second end of the rod section 102 may be threaded to match a first threaded portion of the male threaded connection fitting 162. In an example, the pocket 142 in the second end of the rod section 102 may comprise ¼-20 unified national coarse (UNC)-2B internal threads and the first threaded portion of the male threaded connection fitting 162 may comprise ¼-20 UNC-2A external threads. Similarly, the female threaded connection fitting 164 may be threaded into the pocket 144 in the first end of the second rod section 104 and solidly attached to the second rod section 104 using an epoxy or other applied gluing agent. In an example, the pocket 144 in the first end of the rod section 104 may comprise ¼-20 unified national coarse (UNC)-2B internal threads and the first threaded portion of the female threaded connection fitting 164 may comprise ¼-20 UNC-2A external threads. In an example, the use of internal threads in the pockets 142, 144, and 146 may increase a surface area of the connections upon which the epoxy may act. In an example, a second threaded portion of the male threaded connection fitting 162 may comprise ⅜-16 UNC-2A external threads. Similarly, the female threaded connection fitting 164 may comprise a cavity (or pocket) that may comprise ⅜-16 UNC-2B internal threads.

When the rod sections 102 and 104 of the golf swing simulator/training aid 100 are assembled, the coupling ring 166 is generally placed over the threads of the male threaded connection fitting 162. The coupling ring 166 generally facilitates easy disassembly of the rod sections 102 and 104 (e.g., by preventing the threaded connection fittings being overly tightened during use). In an example, the threaded connection fittings 162 and 164 may be fabrication from half inch diameter aluminum rod. In an example, the threaded connection fittings 162 and 164 may be fabrication from one-half inch diameter 6061-T6 aluminum round bar. In an example, the coupling ring 166 may be implemented as a rubber o-ring. In various embodiments, the rod sections 104 and 106 may be joined together by the threaded coupling 160 similarly to the threaded couplings 120 and 130. In some embodiments, the rod sections 104 and 106 may be joined together by one fitting (e.g., male or female) of the threaded coupling 160 and one fitting (e.g., female or male) of the threaded couplings 120 and 130.

Figure 7A:
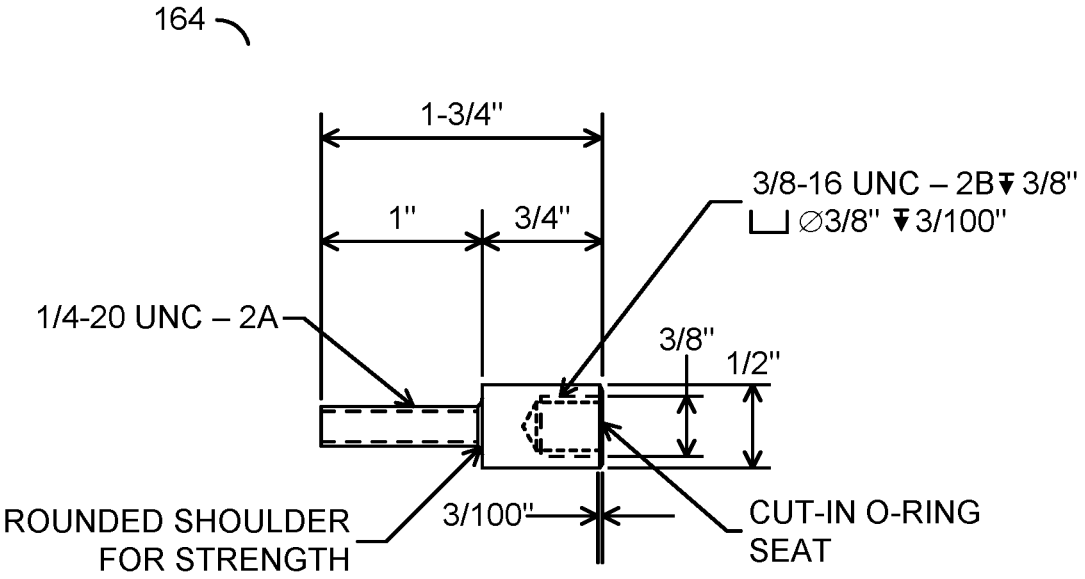
FIG. 7A is a diagram illustrating a female portion of the threaded coupling of FIG. 6.

Referring to FIG. 7A, a diagram is shown illustrating the female threaded connection fitting 164 of FIG. 6. In an example, the female threaded connection fitting 164 may be implemented having an overall length of approximately one and three-quarter inches. The first threaded portion may have a length of approximately one inch. A second portion of the female threaded connection fitting 164 may comprise a cavity (or pocket) that may have a diameter of approximately three-eighths inch and a depth of approximately three-eighths inch. In an example, an interface with a rounded shoulder may be formed between the first threaded portion and the second portion comprising the cavity. In an example, the rounded shoulder may provide added strength. The end of the female threaded connection fitting 164 comprising the cavity may further comprise a cut-in O-ring seat configured to accept the coupling ring 166. In an example, the cut-in O-ring seat may have a depth of a few hundredths of an inch.

Figure 7B:
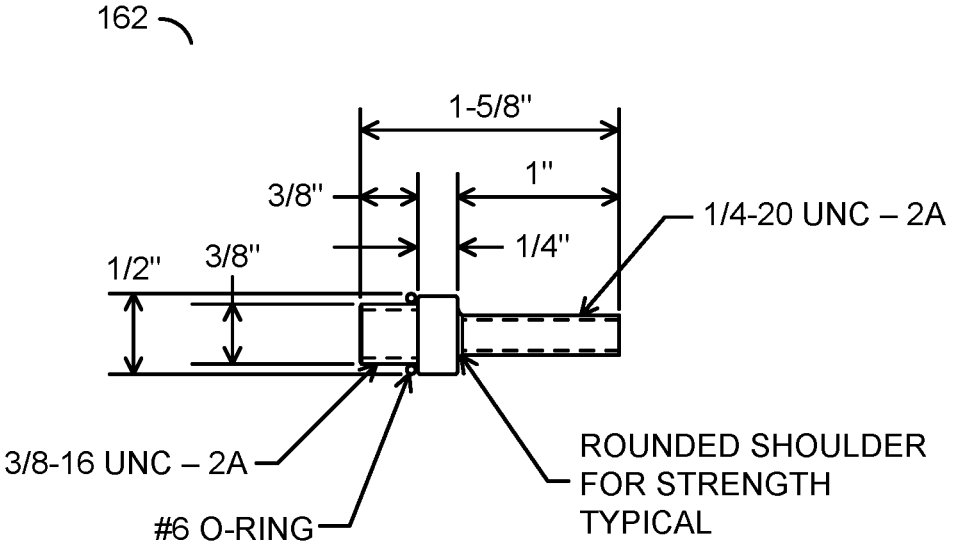
FIG. 7B is a diagram illustrating a male portion of the threaded coupling of FIG. 6.

Referring to FIG. 7B, a diagram is shown illustrating the male threaded connection fitting 162 of FIG. 6. In an example, the male threaded connection fitting 162 may be implemented having an overall length of approximately one and five-eighths inches. The first threaded portion of the male threaded connection fitting 162 may have a length of approximately one inch. The second threaded portion of the male threaded connection fitting 162 may have a length of approximately three-eighths inch. The male threaded connection fitting 162 may have a non-threaded portion between the first threaded portion and the second threaded portion. In an example, the non-threaded portion between the first threaded portion and the second threaded portion may have a length of approximately a quarter inch.

Figure 8:
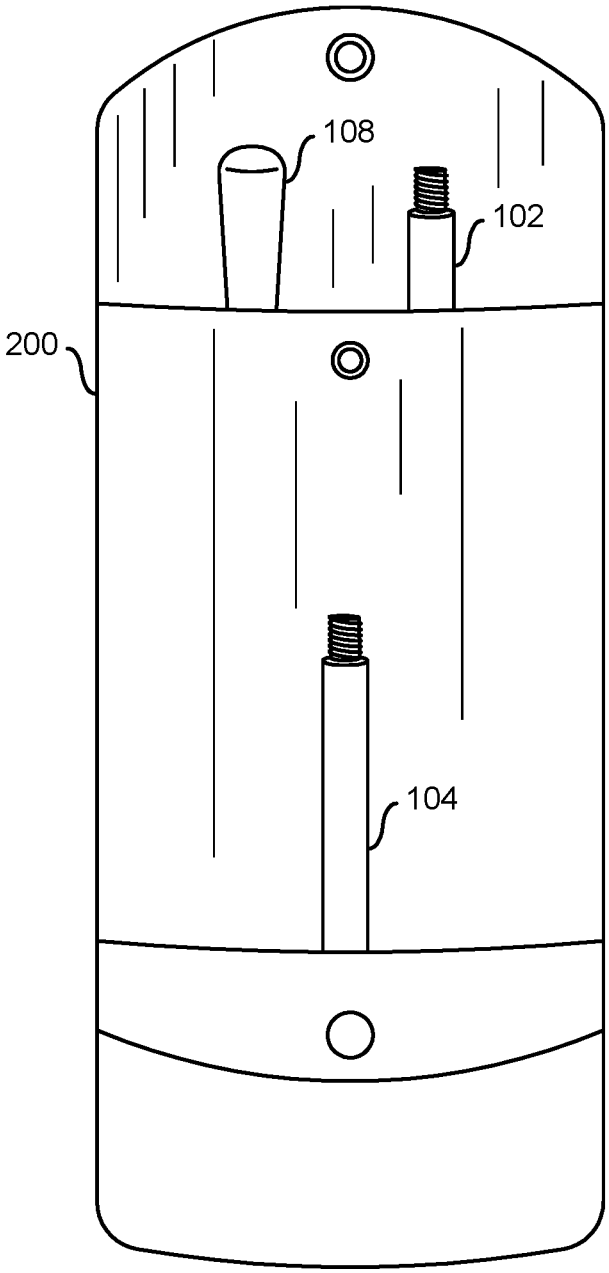
FIG. 8 is a diagram illustrating of a golf swing simulator/training aid in accordance with an example embodiment of the invention in a broken down/disassembled state for ease of carrying and/or storage.

Referring to FIG. 8, a diagram is shown illustrating of a golf swing simulator/training aid in accordance with an example embodiment of the invention in a broken down/disassembled state for ease of carrying and/or storage. In an example embodiment, a carrying/storage case 200 may be used to hold the various components of the golf swing simulator/training aid 100. In an example, the carrying/storage case 200 may comprise a first section configured to hold the rod sections 102 and 106, a second section configured to hold the rod section 104, and a third section configured to hold the auxiliary weights 112 and 114, the retaining ring 116, and the coupling rings 126 and 136. In an example, the first section of the carrying/storage case 200 may be configured to accept (i) the first rod section 102 with the fixed weight 110 attached and (ii) the third rod section 106 with the grip 108 attached. In an example, the third section of the carrying/storage case 200 may be configured as a pouch with flap to secure the small components (e.g., the auxiliary weights 112 and 114, the retaining ring 116, and the coupling rings 126 and 136) within. In an example, the flap may include a fastener (e.g., a snap fastener, a hook and loop type fastener, etc.). In an example, the carrying/storage case 200 may comprise a fabric material such as vinyl, cotton, rip-stop nylon, canvas, etc. In an example, interior surfaces of the carrying/storage case 200 may be coated or treated to provide a smooth surface facilitating easy insertion and extraction of the rod sections and durability. In an example, a lining similar to one found in backpacks may be used.

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. A golf swing simulator/training aid comprising:
- a first rod section;
- a second rod section;
- a third rod section;
- a cylindrical fixed weight secured to a first end of the first rod section;
- a grip attached to and surrounding a second end of the third rod section;
- a first threaded connector fitting removably coupling the first rod section to the second rod section,
- a second threaded connector fitting removably coupling the second rod section to the third rod section;
- one or more auxiliary weights comprising annular rings and configured to be slid along said first rod section and abut said cylindrical fixed weight; and
- a retaining ring configured to be slid along said first rod section and hold said one or more auxiliary weights in position against said cylindrical fixed weight.

2. The golf swing simulator/training aid according to claim 1, wherein a total assembled length is in a range from about 31 inches to about 40 inches.

3. The golf swing simulator/training aid according to claim 1, wherein the first rod section, the second rod section, and the third rod section have a diameter of about one-half inch.

4. The golf swing simulator/training aid according to claim 1, wherein the first rod section, the second rod section, and the third rod section comprise one or more of an acetyl copolymer material and a metal material.

5. The golf swing simulator/training aid according to claim 1, wherein the cylindrical fixed weight comprises stainless steel.

6. The golf swing simulator/training aid according to claim 5, wherein the cylindrical fixed weight is fabricated from one inch diameter 303 stainless steel rod.

7. The golf swing simulator/training aid according to claim 1, wherein said one or more auxiliary weights in position against said cylindrical fixed weight enable the golf swing simulator/training aid to implement a swing moment of a number of regular golf clubs.

8. The golf swing simulator/training aid according to claim 1, wherein the one or more auxiliary weights comprise stainless steel.

9. The golf swing simulator/training aid according to claim 1, wherein the one or more auxiliary weights are fabricated from one inch diameter 303 stainless steel rod.

10. The golf swing simulator/training aid according to claim 1, further comprising a carrying/storage case configured to hold the golf swing simulator/training aid in a disassembled state.

11. The golf swing simulator/training aid according to claim 1, further comprising a carrying/storage case configured to hold one or more auxiliary weights, a retaining ring, and the golf swing simulator/training aid in a disassembled state.

12. The golf swing simulator/training aid according to claim 1, wherein the first threaded connector fitting and the second threaded connector fitting each comprise a male threaded connection fitting, a female threaded connection fitting, and a coupling ring configured to fit over threads of the male threaded connection fitting and prevent over tightening of the threaded connector fitting during use.

13. The golf swing simulator/training aid according to claim 12, wherein each of the male threaded connection fitting and the female threaded connection fitting comprise a tapered portion configured to fit within cavities formed in an end of each of the first rod section, the second rod section, and the third rod section.

14. The golf swing simulator/training aid according to claim 13, wherein the tapered portion of each of the male threaded connection fitting and the female threaded connection fitting are configured to be secured within the cavities formed in the end of each of the first rod section, the second rod section, and the third rod section.

15. The golf swing simulator/training aid according to claim 14, wherein the tapered portion of each of the male threaded connection fitting and the female threaded connection fitting are secured within the cavities formed in the end of each of the first rod section, the second rod section, and the third rod section by an epoxy.

16. The golf swing simulator/training aid according to claim 12, wherein each of the male threaded connection fitting and the female threaded connection fitting comprise a threaded portion configured to fit within cavities formed in the first end and the second end of each of the first rod section, the second rod section, and the third rod section.

17. The golf swing simulator/training aid according to claim 16, wherein the threaded portion of each of the male threaded connection fitting and the female threaded connection fitting are configured to be secured within the cavities formed in the first end and the second end of each of the first rod section, the second rod section, and the third rod section.

18. The golf swing simulator/training aid according to claim 17, wherein the cavities formed in the first end and the second end of each of the first rod section, the second rod section, and the third rod section comprise internal threads and the threaded portion of each of the male threaded connection fitting and the female threaded connection fitting are secured within the cavities formed in the first end and the second end of each of the first rod section, the second rod section, and the third rod section by the internal threads and an epoxy.

19. The golf swing simulator/training aid according to claim 12, wherein each of the male threaded connection fitting and the female threaded connection fitting are fabricated from half inch diameter aluminum rod.

20. The golf swing simulator/training aid according to claim 12, wherein each of the male threaded connection fitting and the female threaded connection fitting are fabricated from one-half inch diameter 6061-T6 aluminum round bar.

* * * * *